United States Patent [19]

Christian

[11] 4,418,836

[45] Dec. 6, 1983

[54] VENDING MACHINE FOR NEWSPAPER, MAGAZINES AND THE LIKE

[76] Inventor: Donald K. Christian, 119 Woodbine Ter., Spartanburg, S.C. 29301

[21] Appl. No.: 286,336

[22] Filed: Jul. 23, 1981

[51] Int. Cl.[3] ..... G07F 11/14

[52] U.S. Cl. ..... 221/37; 221/229; 221/232; 221/241

[58] Field of Search ..... 221/227, 228, 248, 215, 221/155, 157, 33, 37, 44, 45, 52, 43, 103, 110, 229, 232, 226, 261, 241

[56] References Cited

U.S. PATENT DOCUMENTS

| | | | |
|---|---|---|---|
| 1,938,753 | 12/1933 | Niederstadt | 221/232 |
| 2,488,897 | 5/1948 | Blanc | 221/33 X |
| 3,114,475 | 7/1961 | Etes | 221/248 X |
| 3,263,859 | 8/1966 | Searle | 221/227 |
| 3,747,733 | 7/1973 | Knickerbocker | 221/155 X |
| 4,085,864 | 4/1978 | Gordon | 221/155 |
| 4,140,243 | 2/1979 | Etes | 221/215 |
| 4,216,877 | 8/1980 | Dutro | 221/213 |
| 4,319,695 | 3/1982 | Dutro | 221/213 |

*Primary Examiner*—Robert B. Reeves
*Assistant Examiner*—Russell D. Stormer

[57] ABSTRACT

A single copy vending machine for newspapers, magazines or the like which employs a separation device attached to the door of a conventional appearing newspaper vendor to separate the topmost newspaper from a stack thereof subsequent to the insertion of proper coinage and the opening of the door. A sequentially selective elevator mechanism is provided to insure that the topmost newspaper of the stack on the elevator is in the path of the fully retracted separation device. A novel newspaper display chamber is provided to first, facilitate the proper adjustment of the separating device and its relationship with its gauging slides and, secondly, to hold remote, from purchaser access, content of the display chamber until the elevator supply has been exhausted.

4 Claims, 11 Drawing Figures

VENDING MACHINE FOR NEWSPAPER, MAGAZINES AND THE LIKE

BACKGROUND OF THE INVENTION

Over the past many years the need for a newspaper vendor that would dispense one newspaper at a time has been recognized. As far back as 1891 U.S. Pat. No. 464,067 was issued to M. H. Foster for a drop shelf vendor. Other examples of the drop shelf vending of periodicals are U.S. Pat. Nos. 1,256,071 Steiner; 2,753,003 Fancher; 2,904,216 Poland; 3,946,846 Pepiciello and many others. Each, no doubt, an improvement over the other but all relatively slow to load and expensive to produce. Even the present inventor's Application Ser. No. 066,481 which teaches a shelf orientation conducive to loading a multiplicity of papers at one stroke is still substantially more expensive to manufacture and not as fast to load as the conventional semi-honor bulk load vendors. More recently efforts have been expanded to develop bulk load single copy vendors as evidenced by U.S. Pat. Nos. 2,858,047 Williams et al.; 3,114,475 Etes; 3,263,859 Searle; 3,768,695 Pearson; 4,043,484 Vanjo; 4,140,243 Etes; 4,174,047 Owens and others. The bulk loading machines, while generally less expensive to manufacture and quicker to load, have been somewhat unacceptable for one or more of the following reasons: They tend to jam thus irritate potential purchasers. They are awkward to adjust. They are slow to adjust and load. They dispense more than one product. They fail to deliver the product.

The present inventor' U.S. patent application Ser. No. 218,475 tends to minimize the foregoing points but it too is relatively expensive and even more importantly, does not have the same general appearance that the public has come to expect of newspaper vendors. Unfamiliar appearance has been judged at least partially responsible for sales drop in several U.S. cities.

SUMMARY OF THE INVENTION

It is the object of the present invention to materially improve the dependability and customer acceptance of single copy bulk load periodical vending. Another object of the present invention is to provide an improved separatic device for removing one product from a stack of products. Another object of the present invention is to provide a simple adjusting means for compensating for the frequent change in product thickness typical of the publishing industry. It is another object of the present invention to present to the public a periodical vendor of familiar design and function that will reasonably insure full payment for each of the papers removed therefrom.

Generally speaking, the apparatus of the present invention comprises a cabinet, said cabinet containing an access door to a product storage area and a customer access door pivotally mounted therein, through which a single periodical may be removed for each opening thereof, a separation device for removing a single newspaper from a stack of newspapers, an elevator assembly so oriented as to position the topmost periodical of a stack thereof in a predetermined position and an area for containing a display newspaper remote from the customer access area as long as periodicals are available from the principal supply area.

More specifically, the embodiment of the present invention comprises a cabinet which serves as a framework to contain a storage area for a stack of periodicals to be vended. Affixed to said cabinet is a housing to contain an appropriate vending mechanism to hold closed or, upon insertion of proper coinage, release the customer access door of said cabinet in a manner well known to those skilled in the art or as is taught in the present inventor's U.S. patent application Ser. No. 226,018. Contained within said cabinet and affixed to said door is a separation device so oriented as to remove the topmost periodical from the stack thereof as said door is opened. Also contained within above mentioned cabinet is a spring biased elevator to sequentially elevate the stack of periodicals so that the topmost periodical is generally in the path of said separation device when said customer access door has been closed. A shielding device to which the aforementioned separation device is adjustably attached is provided to rest on the topmost periodical. A gauging means is provided whereby an appropriate relationship between said shielding device and said separation device can be readily established. A periodical display area is provided which is composed of a chamber contained generally within the customer access door. The same is functionally transparent on the outside and is so constructed as to contain a display copy of a periodical being held inaccessible to the public until the principal supply of newspapers has been exhausted. Appropriate linkages are provided to make the content of said chamber available in due sequence. Imprinted in such manner as to be visible to the public subsequently, but concealed by said display periodical is the legend "SOLD OUT". The aforementioned spring biased elevator is provided with a brake to obstruct its upward motion beyond a predetermined level and to obstruct its upward motion irrespective of the level when said customer access door is not fully closed. Also provided is a means for relaxing the force of the elevator springs during the loading process. Also provided are such restraining devices as are required to insure the level ascent of said elevator. An appropriate lock and hinge are provided so that the front of the cabinet may be swung away thus providing easy access for rapid loading of the product storage area. Said means for relaxing the force of said elevator springs is attached hereunto.

BRIEF DESCRIPTION OF DRAWINGS

FIG. 4 is a sectional view of the elevator brake taken along lines 4—4 of FIG. 3.

FIG. 5 is a side semi-schematic view showing the suspension of the elevator.

DESCRIPTION OF THE PREFERRED EMBODIMENTS

Making reference to the figures, a specific embodiment of the present invention will now be described in detail.

Figure 1:
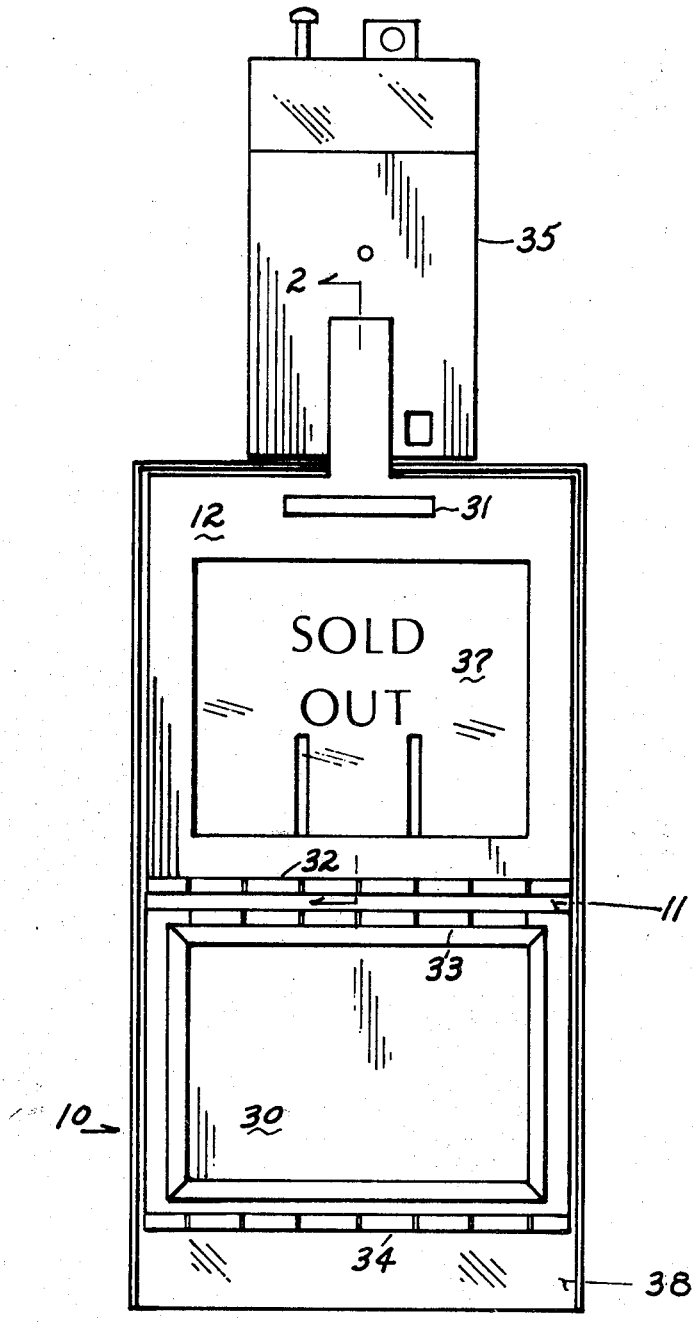
FIG. 1 is the front view of the vending machine

FIG. 1 illustrates a newspaper vending machine. Basically, instant machine is comprised of cabinet generally indicated as 10, purchaser access door 12, card holder 30, coin mechanism enclosure 35, and display area 37. Said purchaser access door, being biased in a closed position is pivotally mounted by spring hinge 32 and provided with handle 31. Said card holder is pivotally suspended from hinge 33.

Figure 7:
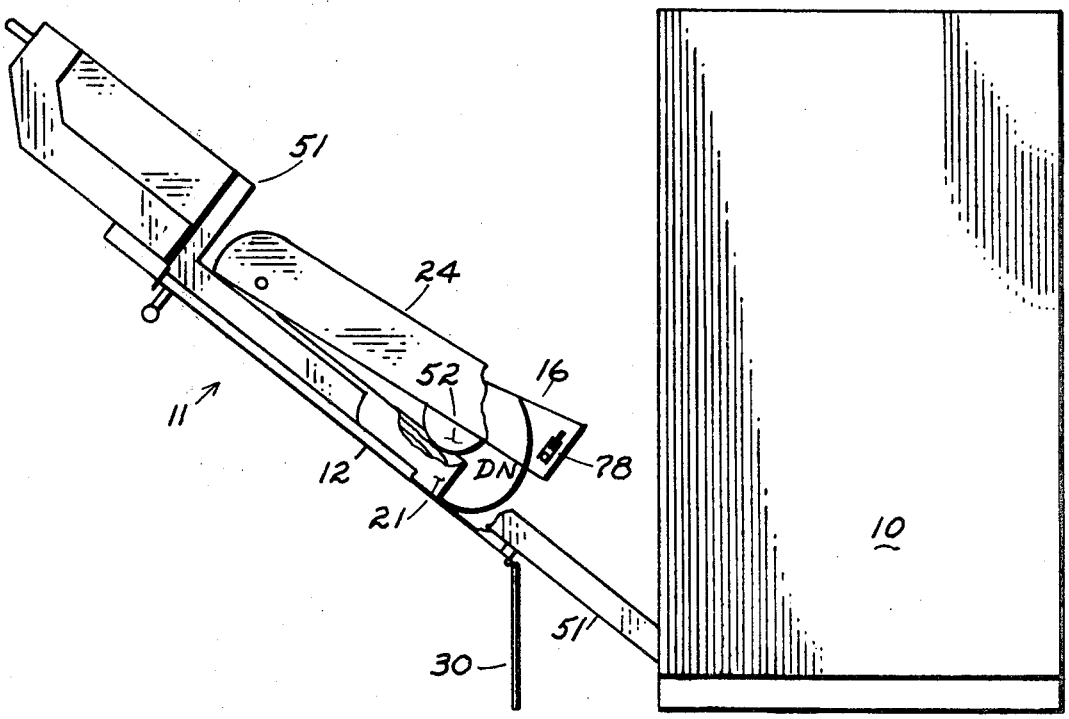
FIG. 7 is a side view of the vendor with access door to product storage area open with scoop-like separation device and shielding device engaged with display area chamber. (Drawer slide has been removed for pictorial convenience.)

Product storage access door 11, to which hinges 32 and 33 are affixed is in turn pivotally mounted to cabinet base 38 by means of hinge 34. Said door 11, to which enclosure 35 is affixed, in conjunction with base 38, comprises the front of the machine. FIG. 7 best illustrates this door assembly.

Figure 2:
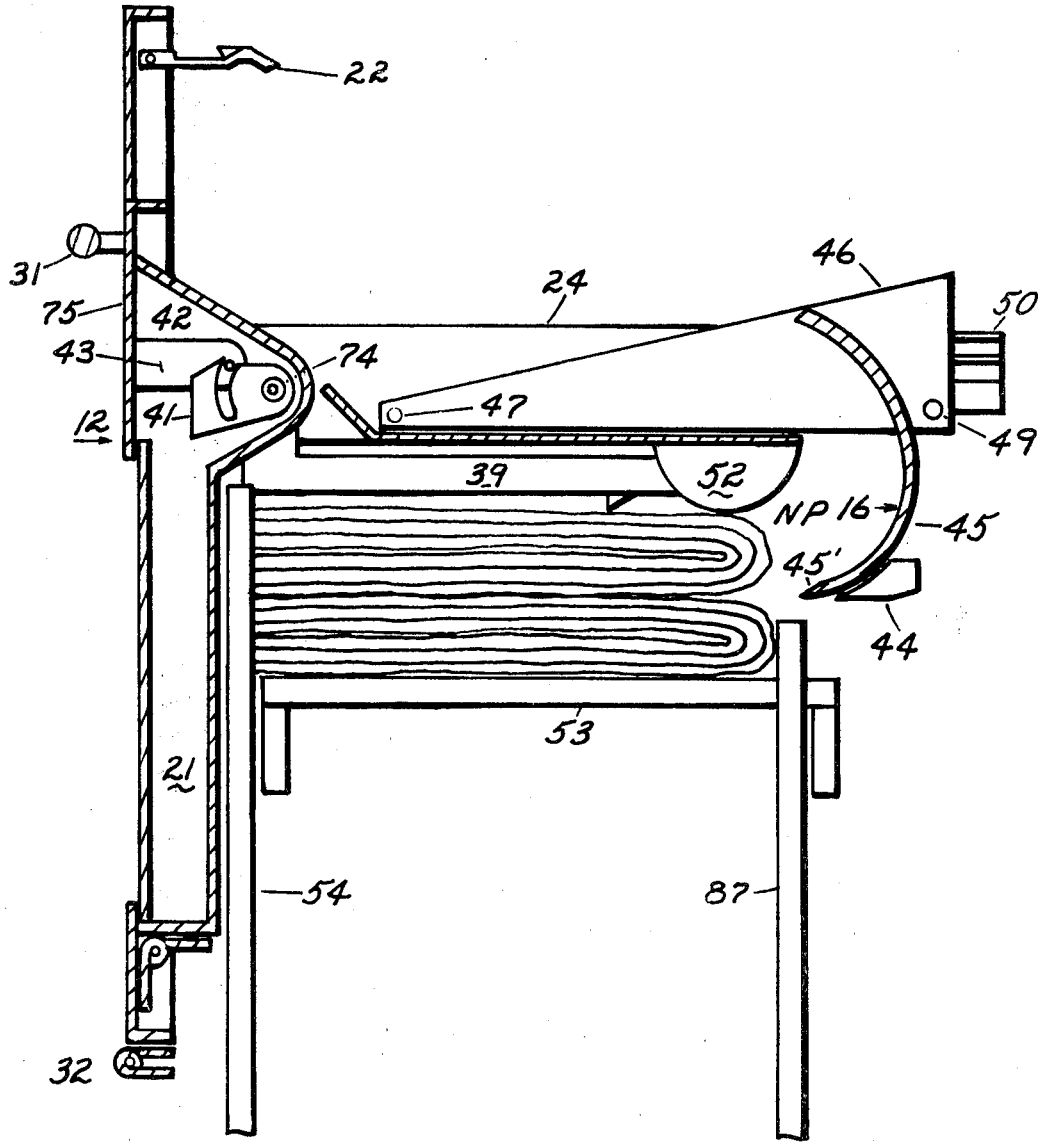
FIG. 2 is a right hand cross-sectional view of the product storage area taken along line 2 of FIG. 1 showing the elevator, the scoop-like separation device, and the customer access door including the display chamber.

In reference to FIG. 2, shield 24 is pivotally secured to linkage 39 which in turn is pivotally secured to display chamber 21 which, in turn, is normally engaged with purchaser access dor 12 by means of hinge 40 and catch 41. Door 12 is provided with pin 42 and support 43, each in turn rigidly affixed to said door.

Separation assembly 16, comprised of wedge 44, scoop 45 and side frames 46 is pivotally secured to shield 24 by pins 47 and secured in place by locking device 78 represented in this view by rod 49. Drawer slides 50, pivotally secured to product access door frame 51, are operatively associated with said separation assembly and shield 24 with gauging slides 52 resting on topmost newspaper, thus positioning point 45' of scoop generally on a plane established by the bottom of topmost newspaper NP and the newspaper adjacent thereto, said newspapers being supported by spring biased elevator platform 53 in a manner more fully described later in the specifications.

Upon the insertion of proper coinage, latch 22 will, in a manner familiar to those skilled in the art, be released. As purchaser exerts outward force on handle 31, door 12 will pivot about hinge 32, shield 24 and separation assembly 16 will move outward causing point 45 to be inserted between the topmost newspaper and the newspaper adjacent thereto. Hopper numbers 54 and 87 are provided to restrain said newspapers. Concave surface of scoop 45 is provided with a low friction finish so that topmost newspaper NP will curl up around the central portion of shield 24 and its rigidly affixed gauging slides 52. As force continues to be exerted outward, newspaper, in a sense, changes its direction thus tending to present its folded edge to the purchaser through the now opening purchaser access door 12. As purchaser continues to exert force on said door, newspaper NP continues to be curled outward as if it were, in a manner of speaking, being handed to the purchaser. When purchaser has removed newspaper and released spring biased door 12, separation assembly 16 is returned to its position of rest as shown in FIG. 2. Upon approaching its position of rest, elevator platform 53 raises the new topmost paper to vend position in a manner that will now be described.

Figure 3:
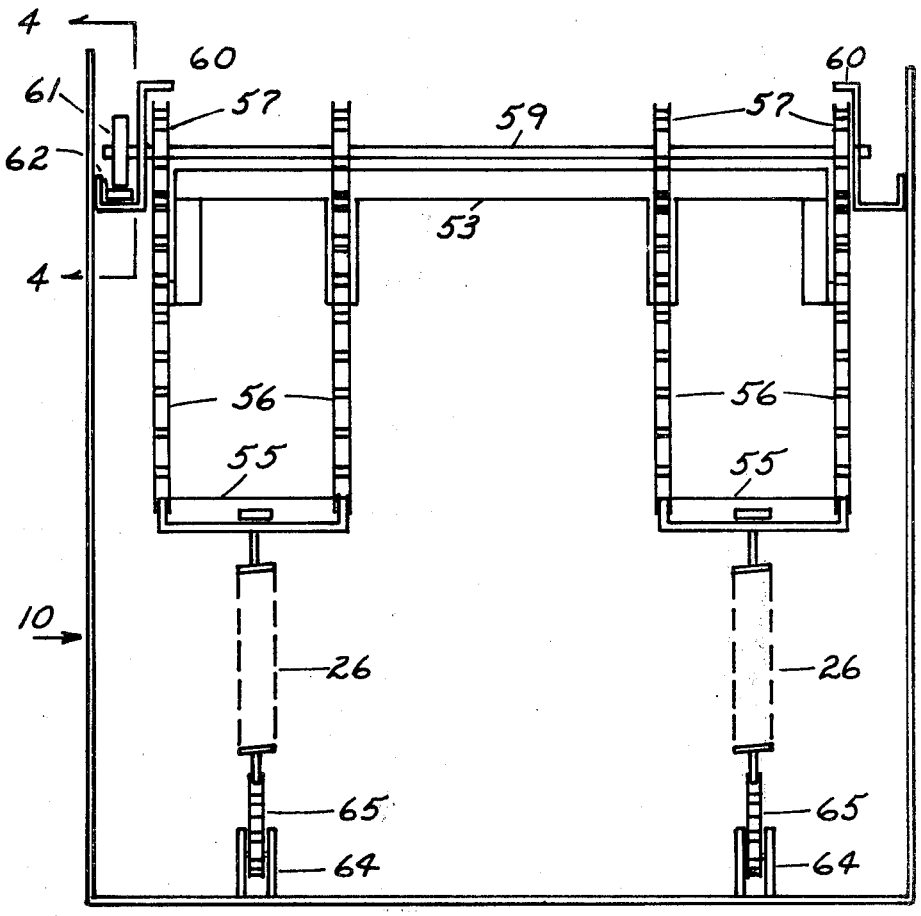
FIG. 3 is a rear view of the elevator.

In reference to FIGS. 3 and 5; with product area access door 11 closed, elevator springs 26 exert sufficient force through cross member 55 and roller chains 56 in conjunction with idlers 65 and anchor 11' to insure the empty platform 53 will rise above level of the scoop point 45' or when newspapers are placed thereon that the topmost one will be in a position of contact with gauging slides 52. When access door 11 is rotated outward about hinge 34, anchor 11', being an integral part of door 11, relaxes the force of springs 26 thus facilitating the loading of said platform. Sprockets 57 are affixed to timing shaft 59 in such manner that, in cooperation with idler sprockets 58, elevator platform will remain substantially level at all elevations. Shaft 59 is rotatably mounted in support members 60 in such manner that brake ratchet 61, being rigidly affixed to said shaft, is held in proper relationship to brake spring 62 as shown in FIG. 4; in turn support members 60 are rigidly affixed to cabinet 10 as are idler brackets 64.

Figure 9:
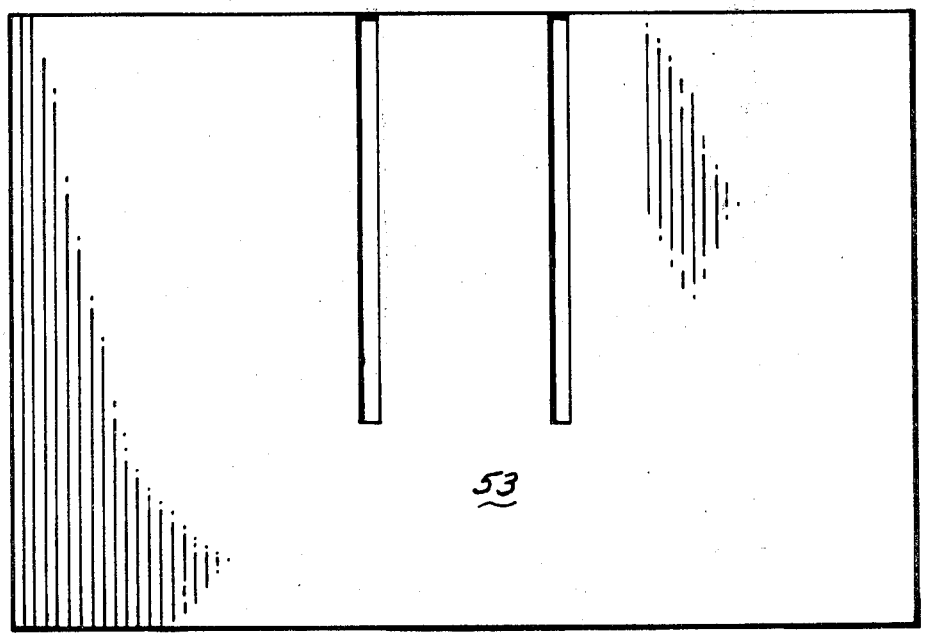
FIG. 9 is top of elevator platform showing relief for gauging slides.

In reference to FIGS. 4 and 9 and again in reference to FIGS. 3 and 5; as shown, elevator platform 53 is held immobile when roller 63, rotatably contained on arm 24', an integral part of shield 24, is not in contact with spring 62. Roller 63 is so oriented as to depress said spring removing it from a position of restraint to the counter clock-wise rotation of timing shaft 59 when purchaser access door 12 is nearly closed and separation assembly 16 is positioned in such manner that the next newspaper is free to rise above point 45'. When no newspapers remain on elevator platform 53, gauging slides 52 will enter openings provided therefore in the surface of said platform permitting point 45' to assume a position below the framework of platform 53. There will not be an interference between scoop 45 and roller chains 56 as might be supposed as scoop 45 is tapered away from point 45' in a spade-like manner thus eliminating that portion thereof which might interfere. It should also be noted that said taper configuration facilitates the entry of said scoop between two newspapers.

Figure 6:
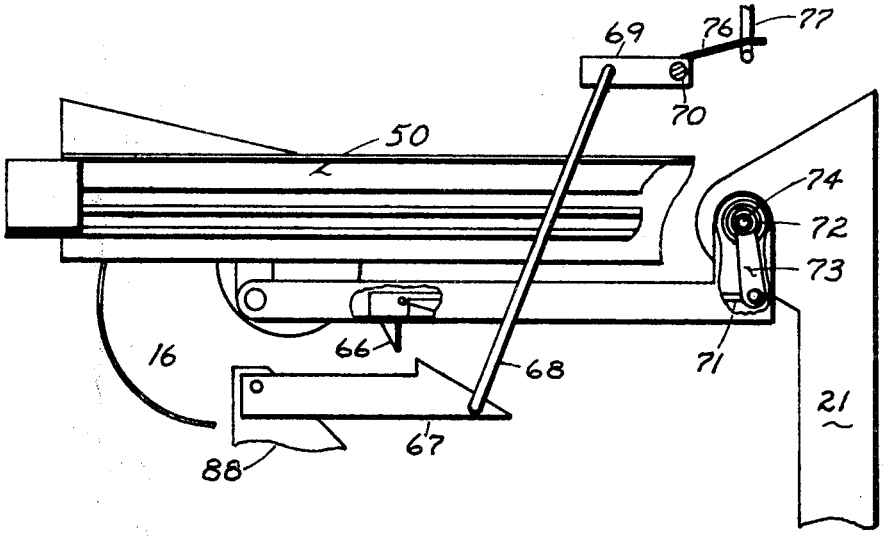
FIG. 6 is a view of the left hand side of scoop-like separation device.

As will now be described, in reference to FIGS. 2 and 6; display newspaper, not shown, contained within display chamber 21 would be released to the next purchaser to insert proper coinage in the vendor after gauging slides 52 enter elevator platform. Finger 66 will now be in a position of engagement with hook 67. Hook 67 is pivotally secured to bracket 88 which in turn is rigidly affixed to support member 60. Operatively associated with hook 67 is linkage 68, lock cam 69 and lock shaft 70. In the case of an empty storage area, as is now being described, the only function of said linkage, cam and shaft is to fix hook 67 in a predetermined position. As purchaser access door 12 is opened, finger 66 engages with hook 67 and, being interconnectedly associated with linkage 71, exerts force on display chamber catch 41 which is rigidly affixed to drive tube 72 and arm 73 which in turn are rotatably associated with shaft 74, said shaft being secured to the ends of display chamber 21. Catch 41 rotates away from pin 42 and outer shell 75 of door 12 opens about hinge 40 exposing the contents of display chamber 21.

Figure 10:
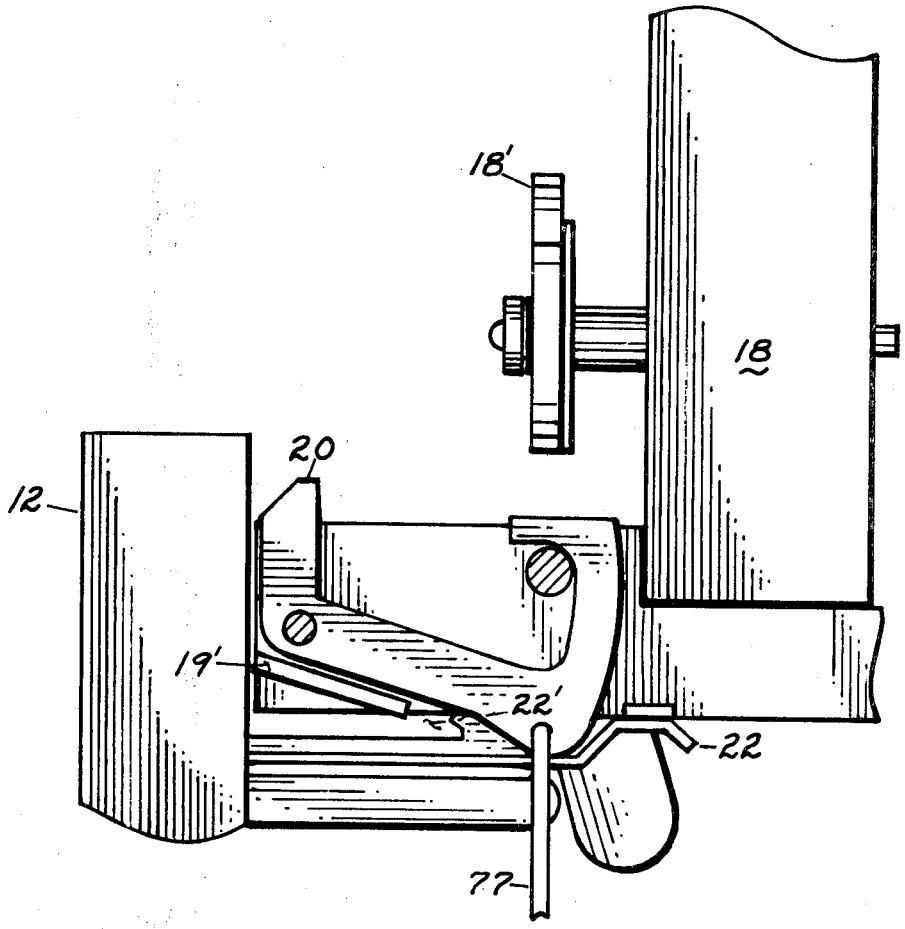
FIG. 10 is a side view of the coin mechanism showing the key release function.

Again in reference to FIGS. 2 and 6 and FIG. 10; operatively associated with lock shaft 70 is a Chicago Lock EXA-107 cylinder lock, lock cam 76 and control rod 77. At such time as a new edition of a newspaper is to be placed in the vendor, a new display copy must be inserted in display chamber 21. Upon activation of said cylinder lock in a clockwise manner, control rod 77 restrains finger 20 in such manner that hook 22', an integral part of latch 22, may be prevented from engaging catch 19', a functional part of frame 51, and access door 12 is free to open. This function is not unlike that performed by cam 18' as proper coinage is inserted in coin mechanism 18. Simultaneous with the lowering of rod 77, linkage 68, being pivotally associated with hook 67, is raised to bring hook 67 into a position of interference with finger 66. As outward force is applied to door 12, separation assembly 16 moves out on drawer slides 50 and finger 66 engages hook 67 releasing outer shell 75 from display chamber 21 thus exposing the interior thereof for replacement. Outer shell 75 is reclosed and lock is restored to its locked position.

Figure 8:
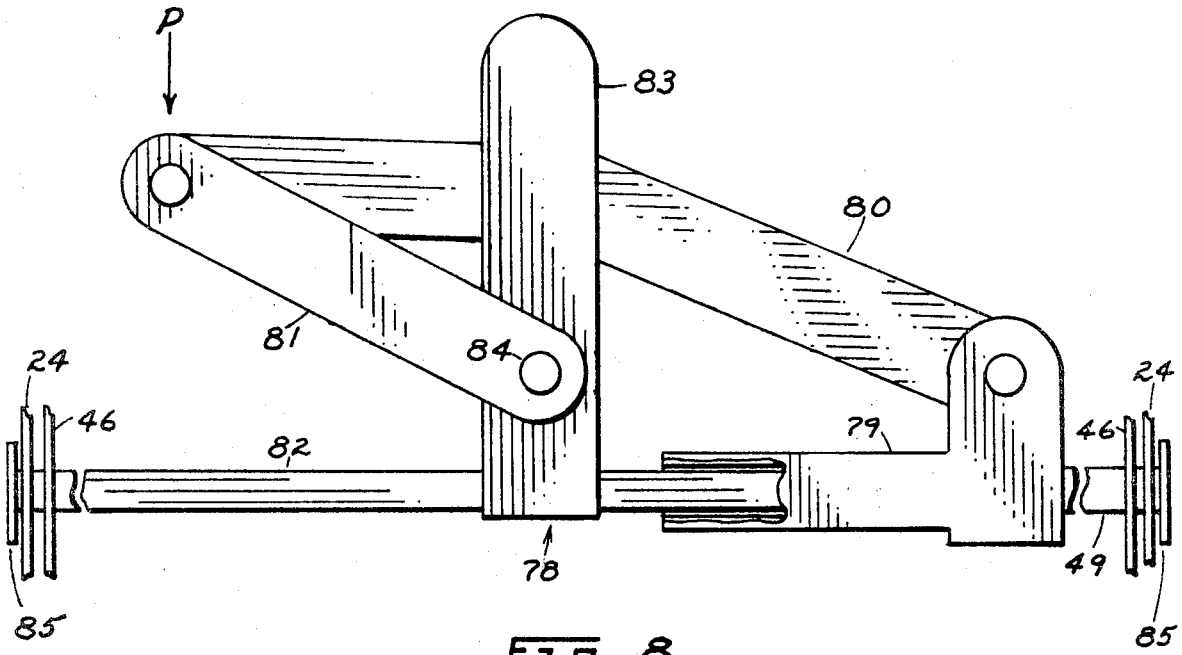
FIG. 8 shows the means for adjusting appropriate relationship between scoop-like separation device and shielding device.

In reference to FIGS. 7 and 8; slide assembly 79 is rigidly affixed to rod 49. Intermediate arm 80 is pivotally secured to slide 79 and lower arms 81. Rod 82 is rigidly affixed to guides 83 and pin 84 extends through guides 83 providing a stop for intermediate arm 80. As pressure is applied to point P, rod 82 enters further into slide 79; pads 85, rigidly affixed to the ends of rods 49 and 82 respectively, draw sides of shield 24 in against side frames 46 which are held apart by scoop 45 in an effective clamping action to maintain a predetermined relationship between said shield and said scoop.

Figure 11:
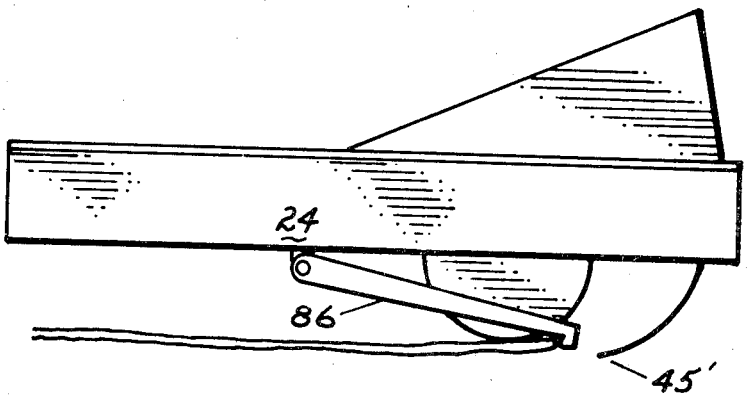
FIG. 11 shows a special hooked member for use with very thin newspapers.

In reference to FIG. 11; a hook member 86, may be suspended from shield 24 in such manner as to lift the edge of a very thin newspaper thus facilitating the entry of point 45' between two said newspapers when otherwise the thinness of the paper might result in the separation of none or of a multiplicity of newspapers. The hook of said hooked member is large enough to catch a very thin paper but small enough to be kept from engagement by the fold radius of a somewhat larger paper that would present no orientation problem to point 45'.

Having described the present invention in detail, it is obvious that one skilled in the art will be able to make modifications and variations thereto without departing from the scope of the invention. Accordingly, the scope of the present invention should be determined by the claims appended hereto.

What is claimed is:

1. A vending machine to dispense single copies of a newspaper, magazine or the like comprising:

(a) a cabinet, said cabinet having a storage area associated therewith;

(b) a coin mechanism assembly mounted thereon, said mechanism having a coin receiving means therein and a release means to permit purchaser access to a chamber wherein is contained a single copy thereof;

(c) a hinged purchaser access door;

(d) a separation device associated with the storage area, operatively associated with said door in such manner that opening of said door will effect the separation of a single copy by inserting a portion of said seperation device generally between the topmost and secondmost copy thereinunder; said separation device moving from the back generally toward the purchaser;

(e) an elevator so oriented as to continue presenting copies of the publication to said separation device.

2. A vending machine to dispense single copies of a newspaper, magazine or the like as described in claim 1 wherein that portion of the seperation device which is to be inserted between the topmost and secondmost copy is so oriented as to cause the topmost copy to curl back over itself as the seperation device moves generally toward the purchaser.

3. A vending machine to dispense single copies of a newspaper, magazine or the like as described in claim 1 wherein the seperation device is provided with an adjusting means to compensate for variations in the thickness of the periodical from one edition to the next; said adjusting means being comprised of a gauging means adjustably associated with that portion of the seperation device which is to be inserted between the topmost and second most copy and, a locating device that may be released and then refixed permitting said insertable portion of said seperation device and said gauging means to assume a positional relationship compatably with any one given edition.

4. An adjusting device as described in claim 3 wherewith is associated a means for positioning one single copy within a display chamber remote from the principal supply yet, so oriented as to permit approximately the same positional relationship between said single copy and a seperation assembly as exists between the topmost copy in said principal supply and said seperation assembly.

* * * * *